US010703548B2

(12) United States Patent
Swatko et al.

(10) Patent No.: US 10,703,548 B2
(45) Date of Patent: Jul. 7, 2020

(54) LOW PROFILE COMPONENT TIE

(71) Applicant: TYCO ELECTRONICS CORPORATION, Berwyn, PA (US)

(72) Inventors: Nicholas John Swatko, Mountain View, CA (US); Thomas D. Ratzlaff, Menlo Park, CA (US)

(73) Assignee: TE CONNECTIVITY SERVICES GMBH, Schaffhausen ( * ) Notice: Subject to any disclaimer, the term of this patent is extended or adjusted under 35 U.S.C. 154(b) by 388 days.

(21) Appl. No.: 14/954,464

(22) Filed: Nov. 30, 2015

(65) Prior Publication Data

US 2017/0152087 A1 Jun. 1, 2017

(51) Int. Cl.
*B65D 63/10* (2006.01)

(52) U.S. Cl.
CPC ..... *B65D 63/1063* (2013.01); *B65D 63/1072* (2013.01); *B65D 63/1081* (2013.01)

(58) Field of Classification Search
CPC ..... B65D 63/1063; B65D 63/1072; B65D 63/1081
See application file for complete search history.

(56) References Cited

U.S. PATENT DOCUMENTS 215,956 A * 5/1879 Miller ..... A44C 5/22 224/176
2,900,696 A * 8/1959 Bacon ..... A01K 27/005 119/856
3,147,522 A * 9/1964 Schumm ..... B65D 63/1081 24/16 PB
3,486,200 A * 12/1969 Orenick ..... B65D 63/1081 24/16 PB
3,618,173 A * 11/1971 Schwartz ..... B65D 63/1081 24/16 PB
3,860,997 A * 1/1975 Van Riper, Jr. .... B65D 63/1081 24/16 PB
4,028,777 A 6/1977 Schobel et al.
4,823,442 A * 4/1989 Behr ..... F16L 33/035 24/16 PB
5,687,455 A * 11/1997 Alexander ..... B65D 63/1072 24/16 PB (Continued)

FOREIGN PATENT DOCUMENTS

DE 10121379 A1 11/2002
FR 2274518 A1 * 1/1976 ..... B65D 63/1081

(Continued)

OTHER PUBLICATIONS

International Search Report dated Mar. 14, 2017, for International Patent Application No. PCT/US2016/064235.

*Primary Examiner* — Robert Sandy
*Assistant Examiner* — Louis A Mercado

(57) ABSTRACT

A low profile component tie includes a strap having a top and a bottom. The strap is configured to wrap around a component with the bottom facing the component. The strap has sides between the top and the bottom. The strap has teeth disposed along at least one of the sides. The strap extends between a root end and a distal end. A head is provided at the root end of the strap. The head has a channel configured to receive the strap. The head has at least one pawl provided in the channel. The pawl engages at least one of the teeth along the side of the strap to secure the strap in the head.

17 Claims, 7 Drawing Sheets

(56) References Cited

U.S. PATENT DOCUMENTS

| | | | | |
|---|---|---|---|---|
| 7,438,085 | B2 * | 10/2008 | Ratermann | F16K 35/12 137/379 |
| 9,878,835 | B2 * | 1/2018 | Winter | B65D 63/1081 |
| 2016/0368680 | A1 * | 12/2016 | Winter | B65D 63/1072 |

FOREIGN PATENT DOCUMENTS

| | | | | |
|---|---|---|---|---|
| FR | 2300245 | A1 | 9/1976 | |
| FR | 2301717 | A1 * | 9/1976 | B65D 63/1081 |
| FR | 2732728 | A1 | 10/1996 | |
| JP | H09210020 | A | 8/1997 | |
| WO | WO 2007/102828 | A1 | 9/2007 | |

* cited by examiner

LOW PROFILE COMPONENT TIE

BACKGROUND OF THE INVENTION

The subject matter herein relates generally to a low profile component tie.

Component ties are used to secure and tie one or more components, such as cables. Such cable ties may tie the cables together in a bundle and/or tie the cables to another structure. Cable ties typically include a retention mechanism and a strap that is secured around the components to the retention mechanism.

However, known cable ties are not without disadvantages. For example, the retention mechanisms are typically bulky and extend a considerable distance outward from the cable or cable bundle, increasing the overall bundle diameter. The retention mechanisms are typically block shaped and define snag points for the cable bundle. For example, when the cable bundle is routed through a structure or chassis, such as within a building, machine, vehicle or aircraft, the block shaped retention mechanism may snag or catch on a portion of the structure or on another cable tie of an adjacent cable bundle.

Furthermore, conventional cable ties have a top side and a bottom side with the head of the retention mechanism extending upward above the top side. Because the head extends above the top side, the bottom side must face the cable. The cable tie can only be assembled to the cable in a single orientation. If the cable tie is initially assembled backwards with the top side facing the cable, the cable tie must be dis-assembled (if assembled), unwrapped, flipped over and re-wrapped and assembled. Such process may be time consuming.

A need remains for a low profile component tie that overcomes one or more of the above noted deficiencies and is an improvement to existing cable tie designs.

BRIEF SUMMARY OF THE INVENTION

In one embodiment, a low profile component tie is provided including a strap having a top and a bottom. The strap is configured to wrap around a component with the bottom facing the component. The strap has sides between the top and the bottom. The strap has teeth disposed along at least one of the sides. The strap extends between a root end and a distal end. A head is provided at the root end of the strap. The head has a channel configured to receive the strap. The head has at least one pawl provided in the channel. The pawl engages at least one of the teeth along the side of the strap to secure the strap in the head.

In another embodiment, a low profile component tie is provided including a strap having a top and a bottom and sides between the top and the bottom. The strap has teeth disposed along at least one of the sides. The strap extends between a root end and a distal end. A head is provided at the root end of the strap. The head has a top and a bottom. The head has a channel configured to receive the strap. The head has at least one pawl provided in the channel engaging at least one of the teeth along the side of the strap to secure the strap in the head. The strap and the head are symmetrical about a central plane between the corresponding top and bottom such that the head and the strap are configured to be positioned on a component with the strap wrapping around the component to the head in a first orientation with the bottom facing the component and in a second orientation with the top facing the component.

In a further embodiment, a low profile component tie is provided including a strap having a top and a bottom extending between a root end and a distal end. The strap is configured to wrap around a component with the bottom facing the component. The strap has sides between the top and the bottom and teeth disposed along at least one of the sides. The strap has a band below the teeth at or near the bottom. A head is provided at the root end of the strap. The head has a channel configured to receive the strap. The head has at least one pawl provided in the channel. The at least one pawl engages at least one of the teeth along the corresponding side of the strap to secure the strap in the head. The band engages the at least one pawl.

DETAILED DESCRIPTION OF SPECIFIC EMBODIMENTS OF THE INVENTION

Figure 1:
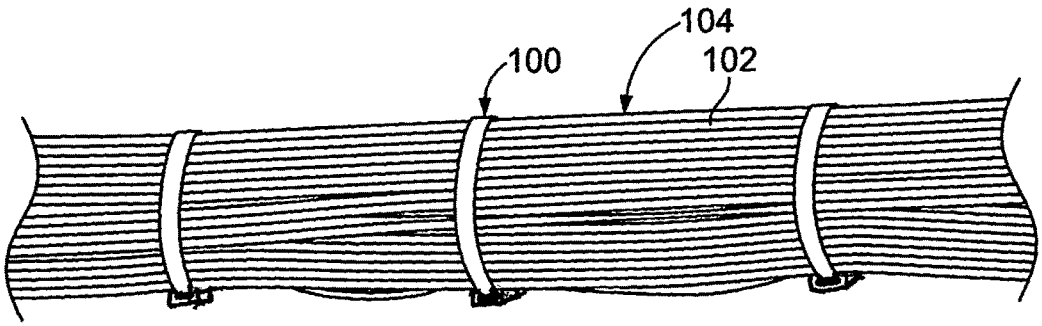
FIG. 1 illustrates a plurality of low profile component ties formed in accordance with an exemplary embodiment.

FIG. 1 illustrates a plurality of low profile component ties 100 formed in accordance with an exemplary embodiment. The component ties 100 are secured to one or more components 102. For example, the component ties 100 wrap around the components 102 and are self-secured to hold or bundle the components 102. In the illustrated embodiment, the components 102 are cables arranged as a cable bundle 104. However, the component ties 100 may be used to secure other types of components in alternative embodiments. The component ties 100 may secure the components 102 together to each other as part of a bundle and/or may secure the component 102 to another device or structure.

In an exemplary embodiment, each component tie 100 has a low profile to minimize impact to the overall bundle diameter of the cable bundle 104. The low profile component tie 100 minimizes snag points by being low profile, which may reduce damage to neighboring components or bundles. The low profile component tie 100 allows tighter spacing of various cable bundles 104. The low profile component tie 100 allows routing or pulling of the cable bundle 104 through a bulkhead, chassis or other structural component easier than bulky cable ties (e.g., through a smaller opening or space, reduced snag, and the like). The component tie 100 has a lower profile than conventional cable ties by providing a low profile head as compared to conventional cable ties. For example, conventional cable ties may have a retention mechanism head having a height of approximately 10.0 mm, whereas the low profile component tie 100 may have a height of approximately 2.5 mm or less. The head of the low profile component tie 100 may be only slightly taller than the strap itself. For example, the head may be approximately 2-3 times the height of the strap as opposed to conventional cable ties where the head of the retention mechanism is significantly taller than the strap.

Figure 2:
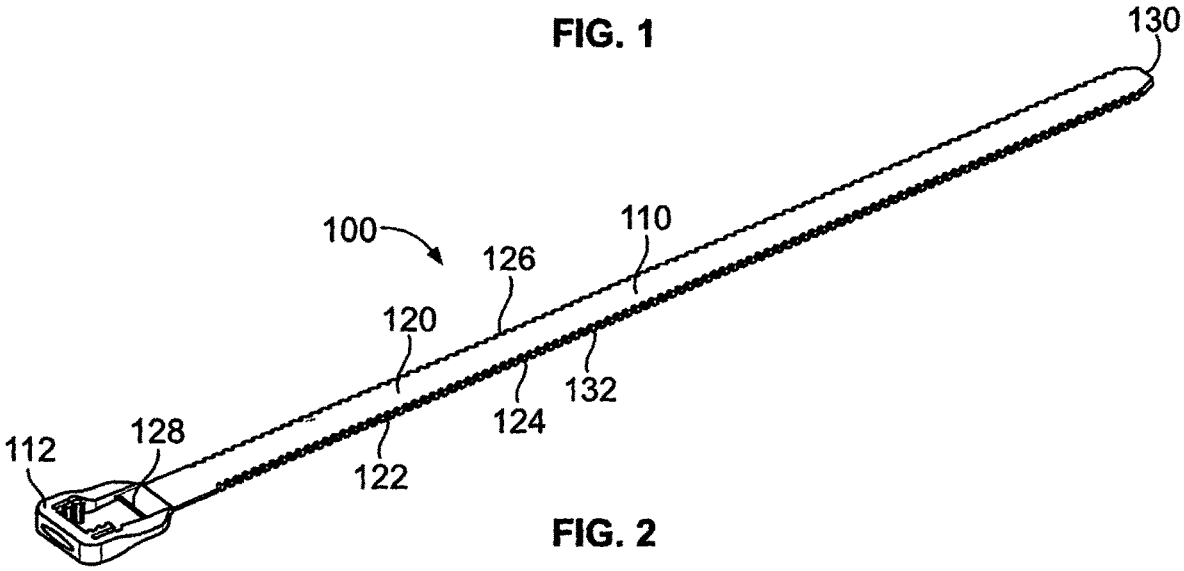
FIG. 2 illustrates a low profile component tie in an extended or unwrapped state.
Figure 3:
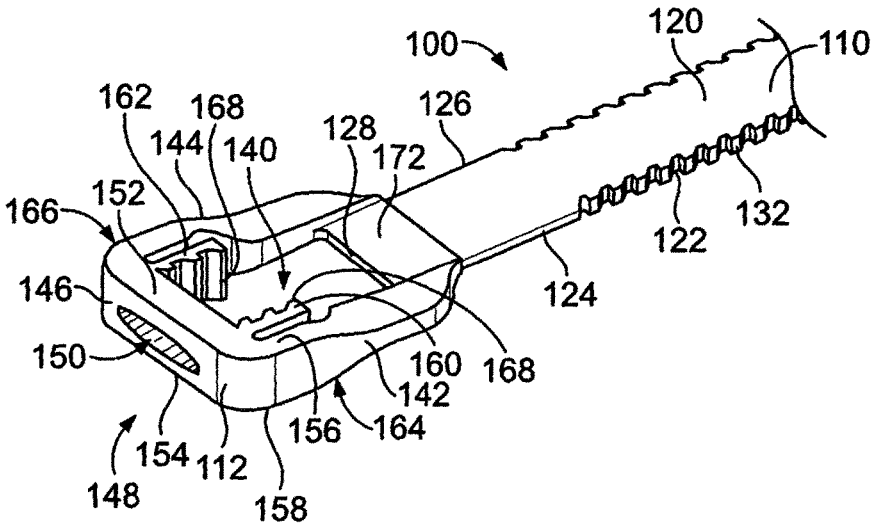
FIG. 3 is an enlarged view of a portion of the component tie shown in FIG. 2.
Figure 4:
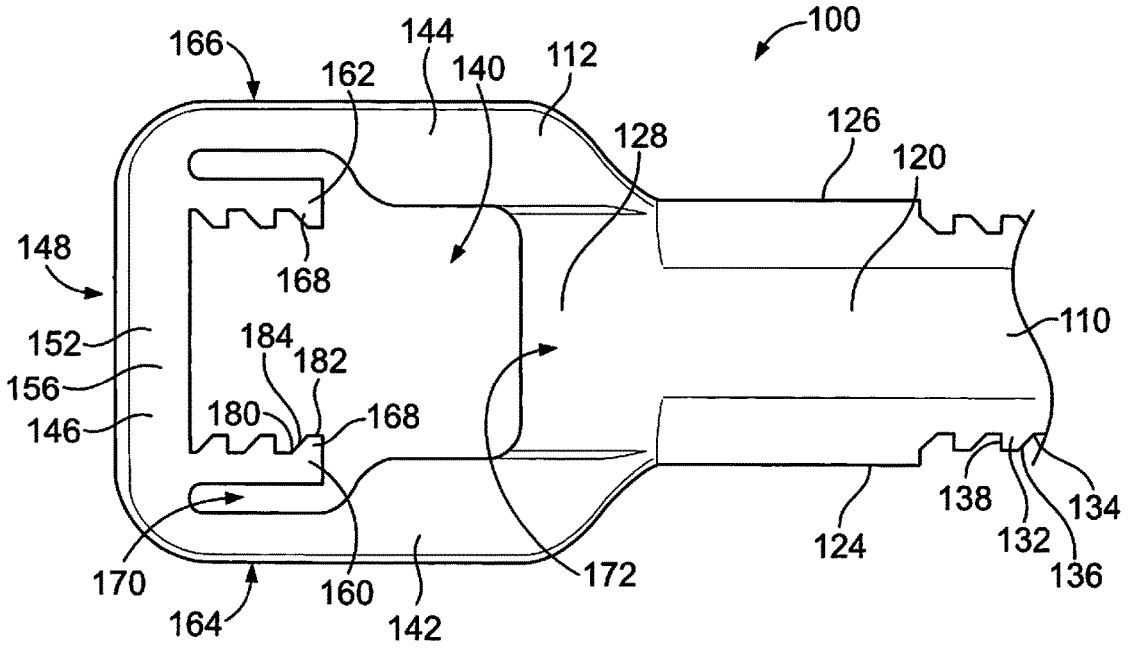
FIG. 4 is a top view of a portion of the component tie shown in FIG. 2.
Figure 5:
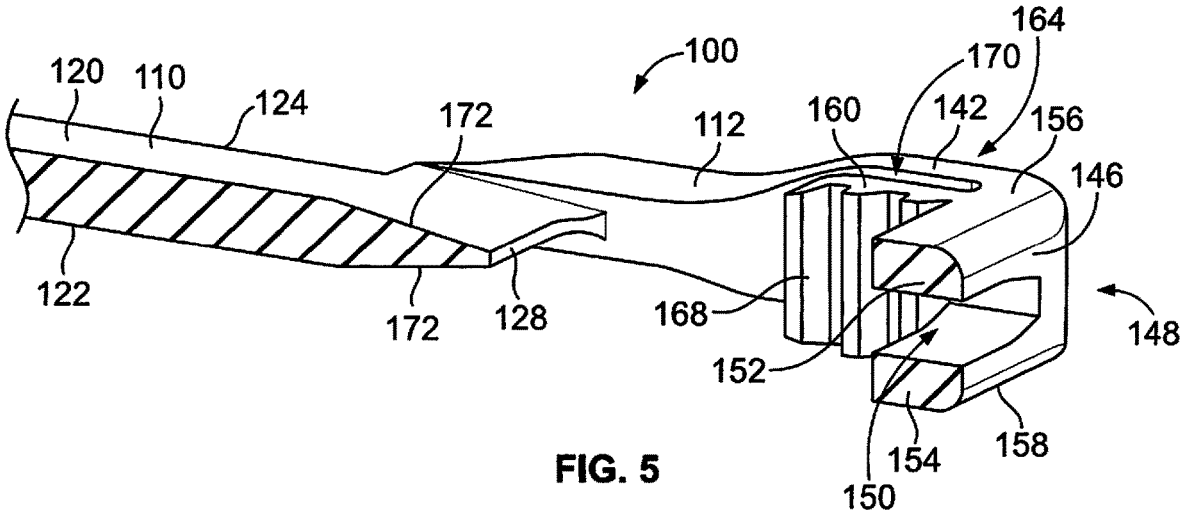
FIG. 5 is a partial sectional view of a portion of the component tie shown in FIG. 2.
Figure 6:
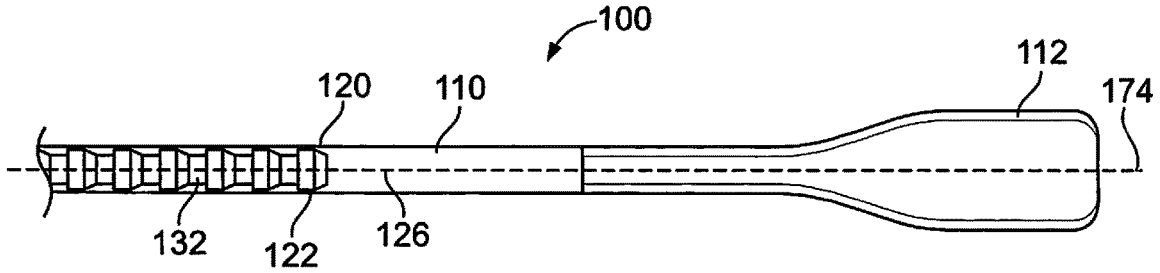
FIG. 6 is a side view of the component tie shown in FIG. 2.
Figure 7:
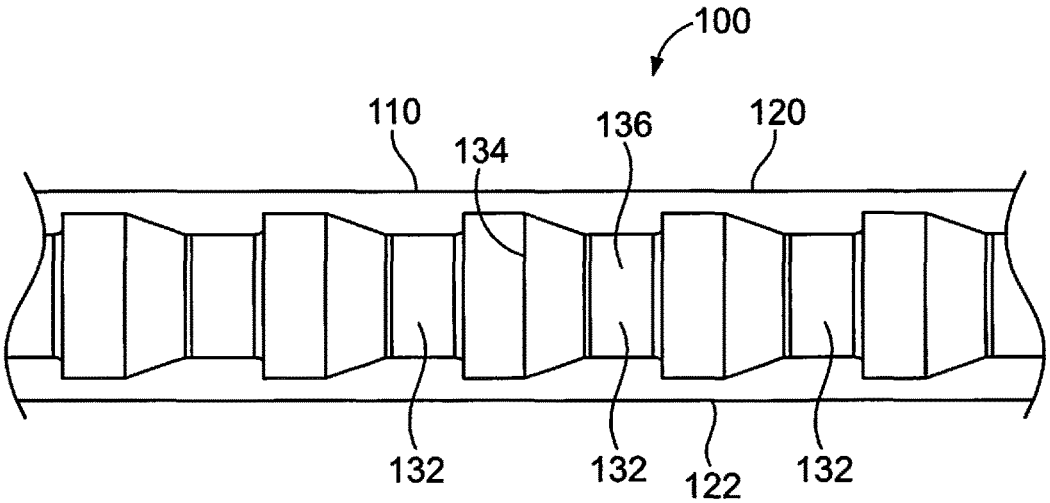
FIG. 7 is an enlarged side view of a portion of the component tie shown in FIG. 2.
Figure 8:
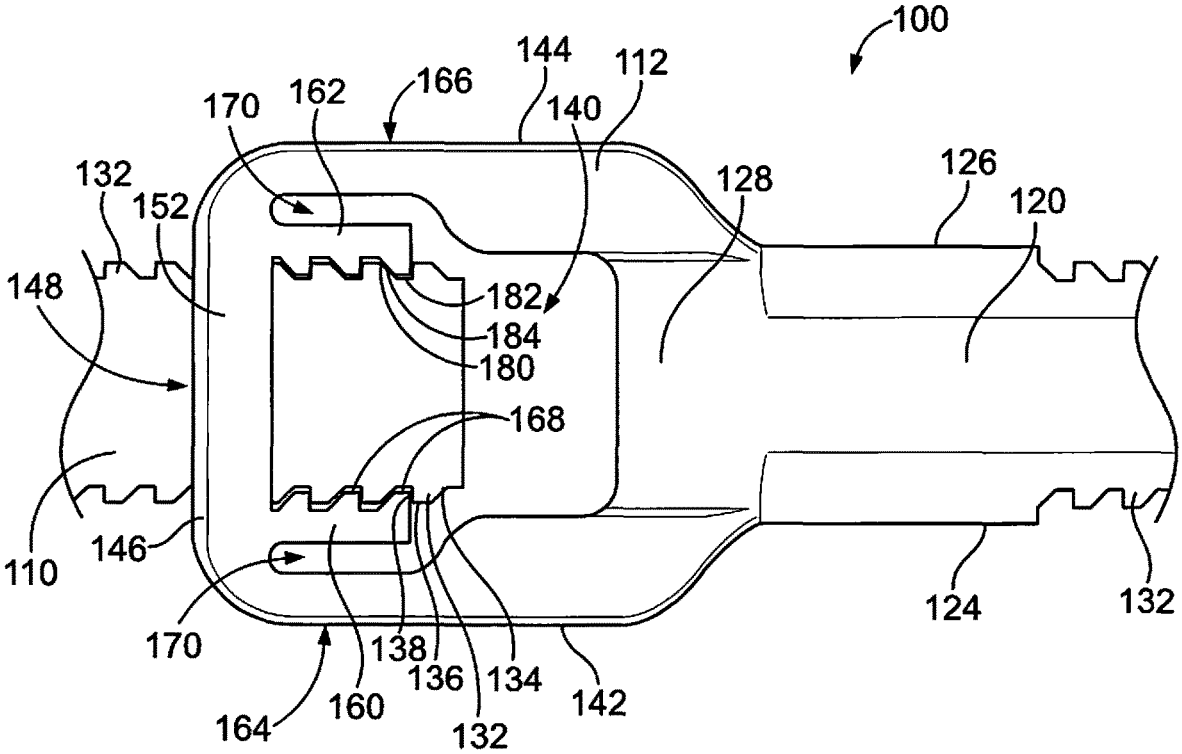
FIG. 8 is a top view of a portion of the component tie shown in FIG. 2 showing the component tie in an assembled state.

FIG. 2 illustrates the low profile component tie 100 in an extended or unwrapped state. FIG. 3 is an enlarged view of a portion of the component tie 100. FIG. 4 is a top view of a portion of the component tie 100. FIG. 5 is a partial sectional view of a portion of the component tie 100. FIG. 6 is a side view of the component tie 100. FIG. 7 is an enlarged side view of a portion of the component tie 100. FIG. 8 is a top view of a portion of the component tie 100 showing the component tie 100 in an assembled state.

The component tie 100 includes a strap 110 and a head 112 provided at an end of the strap 110. The strap 110 extends a length from the head 112 and may be self-secured to the head 112 after wrapping around one or more of the components 102 (shown in FIG. 1). Optionally, different component ties 100 may be provided having different lengths. In an exemplary embodiment, the component tie 100 is manufactured from a plastic material, such as nylon, polypropylene, PEEK, and the like. In other various embodiments, the component tie 100 may be manufactured from metal material, such as stainless steel, aluminum, titanium, and the like. The strap 110 is formed integral with the head 112. Optionally, the component tie 100 may be molded during a molding process.

The strap 110 has a top 120 and a bottom 122 opposite the top 120. The strap 110 includes sides 124, 126 extending between the top 120 and the bottom 122. The sides 124, 126 have a height measured by the thickness between the top 120 and the bottom 122. The strap 110 extends between a root end 128 and a distal end 130 opposite the root end 128. The head 112 is provided at the root end 128. The distal end 130 is configured to be wrapped around the one or more components 102 and coupled to the head 112 (FIG. 8). The strap 110 has a width defined between the sides 124, 126. The strap 110 has a length defined between the root end 128 and the distal end 130. Families of component ties 100 may be provided having various lengths and/or widths for various applications. Optionally, the distal end 130 may be tapered to ease insertion into the head 112.

In an exemplary embodiment, the strap 110 includes a plurality of teeth 132 disposed along the first side 124 and/or the second side 126. The teeth 132 may be contained within the thickness. Optionally, the teeth 132 may have a thickness less than a thickness of a central portion of the strap 110 (FIGS. 6 and 7). The teeth 132 may have any appropriate shape for securing the strap 110 to the head 112. The teeth 132 may have a uniform spacing or pitch therebetween along the length of the strap 110.

The head 112 is provided at the root end 128 of the strap 110. The head 112 includes a channel 140 configured to receive the strap 110. The head 112 includes first and second arms 142, 144 on opposite sides of the channel 140. The head 112 includes an end wall 146 at a loading end 148 of the head 112 generally opposite the root end 128. The strap 110 is configured to be loaded into the channel 140 through the end wall 146 at the loading end 148. For example, the strap 110 may be loaded through an opening 150 in the end wall 146. The opening 150 may be defined by an upper support bar 152 and/or a lower support bar 154. The upper support bar 152 is provided at a top 156 of the head 112 while the lower support bar 154 is provided at a bottom 158 of the head 112. As such, the end wall 146 encloses the strap 110 entirely circumferentially around the strap 110 (e.g., top, bottom and both sides) to position the strap 110 in the channel 140. Optionally, the portion of the head 112 above the strap 110 (e.g., the upper support bar 152) and the portion of the head 112 below the strap 110 (e.g., the lower support bar 154) are thin to maintain the low profile of the component tie 100. For example, the upper support bar 152 may have a thickness approximately equal to or less than a thickness of the strap 110. Similarly, the lower support bar 154 may have a thickness approximately equal to or less than a thickness of the strap 110.

The opening 150 is shaped to receive the strap 110 (e.g., the opening 150 has a complementary shape as the outer profile of the strap 110, including the teeth 132). Optionally, the opening 150 may be shaped to align and position the strap 110 in the channel 140. For example, the opening 150 may hold the strap 110 side-to-side and up-and-down to limit side-to-side movement and up-and-down movement of the strap 110. The opening 150 may include a lead-in or chamfer to guide loading of the strap 110 into the opening 150. Alternatively, the distal end 130 of the strap 110 may be tapered to lead into the opening 150.

In an exemplary embodiment, the head 112 includes one or more pawls in the channel 140. In the illustrated embodiment, the head 112 includes a first pawl 160 and a second pawl 162. The first pawl 160 is provided at a first side 164 of the head 112, such as at or near the first arm 142, and the second pawl 162 is provided at a second side 166 of the head 112, such as at or near the second arm 144. The pawls 160, 162 may extend from the end wall 146, such as generally parallel to and spaced apart from the arms 142, 144. The pawls 160, 162 are contained within the channel 140 below the top and above the bottom of the head 112 to reduce the overall height of the head 112.

The pawls 160, 162 include pawl teeth 168 configured to be received in the spaces between the teeth 132 of the strap 110 to engage the teeth 132 to hold the position of the strap 110 with respect to the head 112 (FIG. 8). For example, as the strap 110 is loaded through the opening 150 into the channel 140, the pawls 160, 162 ratchet down the sides of the strap 110. The dual pawls 160, 162 apply counter-acting compressive forces inward to center the strap 110 within the channel 140. In alternative embodiments having a single pawl, such single pawl may press the strap 110 toward one side against a datum or stop surface to position the strap 110 in the channel 140. By providing the pawls 160, 162 along the sides, as opposed to along the top or the bottom, the head 112 has a lower profile. The pawls 160, 162 resist back out of the strap 110 from the head 112 to lock the strap 110 in the head 112. Optionally, the pawls 160, 162 may be releasable, such as with a tool, to allow removal of the strap 110. Each pawl 160, 162 may include any number of pawl teeth 168, including a single pawl tooth. Optionally, one of the pawl teeth 168 may be defined by a distal end of the corresponding pawl 160, 162.

In an exemplary embodiment, the pawls 160, 162 are deflectable. The pawls 160, 162 may be cantilevered from the head 112 and gaps 170 (FIG. 4) may be provided outside of the pawls 160, 162 to allow the pawls 160 162 to deflect outward during loading of the strap 110 into the head 112. For example, the gaps 170 may be provided between the pawls 160, 162 and the arms 142, 144. The pawls 160, 162 are deflectable within a horizontal plane of the head 112 (e.g., side-to-side), which may reduce the overall height of the head 112.

In an exemplary embodiment, the strap 110 and/or the head 112 includes a ramp 172 at the root end 128 (FIG. 5). The ramp 172 is provided at the end of the channel 140 to guide the distal end 130 of the strap 110 as the distal end 130 of the strap 110 is loaded through the channel 140. The ramp 172 may guide the strap 110 toward the top 120. Optionally, the ramp 172 may additionally or alternatively guide the strap toward the bottom 122. For example, the tip of the ramp 172 may be positioned below the top 120 and/or above the bottom 122 and be ramped to the top 120 and/or the bottom 122. Optionally, the tip of the ramp 172 may be positioned below the top 156 of the head 112 and/or above the bottom 158 of the head 112.

In an exemplary embodiment, the strap 110 is centered with respect to the head 112 (FIG. 6). For example, the strap 110 is vertically centered on the head 112 between the top 156 and the bottom 158. As such, the component tie 100 may be symmetrical about a horizontal or central plane 174 (FIG. 6). The component tie 100 may be secured to the component 102 with the bottom side down or the top side down and install and operate the same. Optionally, when the component tie 100 is symmetrical, the direction that the component tie 100 is wrapped around the component 102 is irrelevant. The installer does not need to be as careful about making sure that the bottom side faces the component 102 for proper installation, as is the case with conventional cable ties where the head must be on the outside for proper installation. Installation time may be reduced by providing a symmetrical component tie 100 as the component tie 100 does not need to be disassembled and turned over if accidentally wrapped with the wrong side facing the component 102. In alternative embodiments, the strap 110 may be provided at the bottom 158 (or at the top 156) of the head 112 rather than being centered on the head 112. Providing the strap 110 on the bottom 158 may allow tighter wrapping of the component 102 as no gaps or spaces are provided between the component tie 100 and the component 102.

Optionally, the strap 110 may be oblong. For example, the strap 110 may be oval shaped. The sides 124, 126 may be curved (FIG. 6). For example, the strap 110 may be thicker along the central portion and thinner along the sides 124, 126. Having the sides 124, 126 curved eliminates sharp edges, which may damage the components 102. Optionally, the top 120 and/or the bottom 122 may be generally flat and slightly tapered inward at the sides 124, 126. Optionally, the teeth 132 may be narrower than the central portion of the strap 110 (FIG. 7). As such, the teeth 132 may be held spaced apart from the components 102 when the strap 110 is wrapped around the components 102. Positioning the teeth 132 away from the component 102 reduces a risk of damage to the component 102, such as from digging into or cutting the component 102. In an exemplary embodiment, the teeth 132 may be tapered. For example, the teeth 132 may be wider near a base 134 of the teeth 132 and narrower at a tip 136 of each of the teeth 132. The top and bottom of the teeth 132 between the base 134 and the tip 136 may be curved or may be angled inward from the base 134 to the tip 136. Optionally, the teeth 132 may be ramped at front sides thereof. The teeth 132 may include undercuts 138 at the back sides thereof.

The pawl teeth 168 each extend from a base 180 to a tip 182. The pawl teeth 168 may have ramps 184 along the back sides of the pawl teeth 168. Optionally, front sides of the pawl teeth 168 may be undercut, such as to receive the undercuts 138 of the teeth 132 of the strap 110 when mated thereto. Optionally, the pawl teeth 168 may have different widths. For example, the forward most pawl teeth 168 may be wider than the rearward most pawl teeth 168. Having narrower pawl teeth 168 at the rear end of the pawls 160, 162 allows the strap 110 to be more easily inserted into the channel 140. For example, the pawls 160, 162 do not need to be deflected as far to clear the shorter pawl teeth 168.

Figure 9:
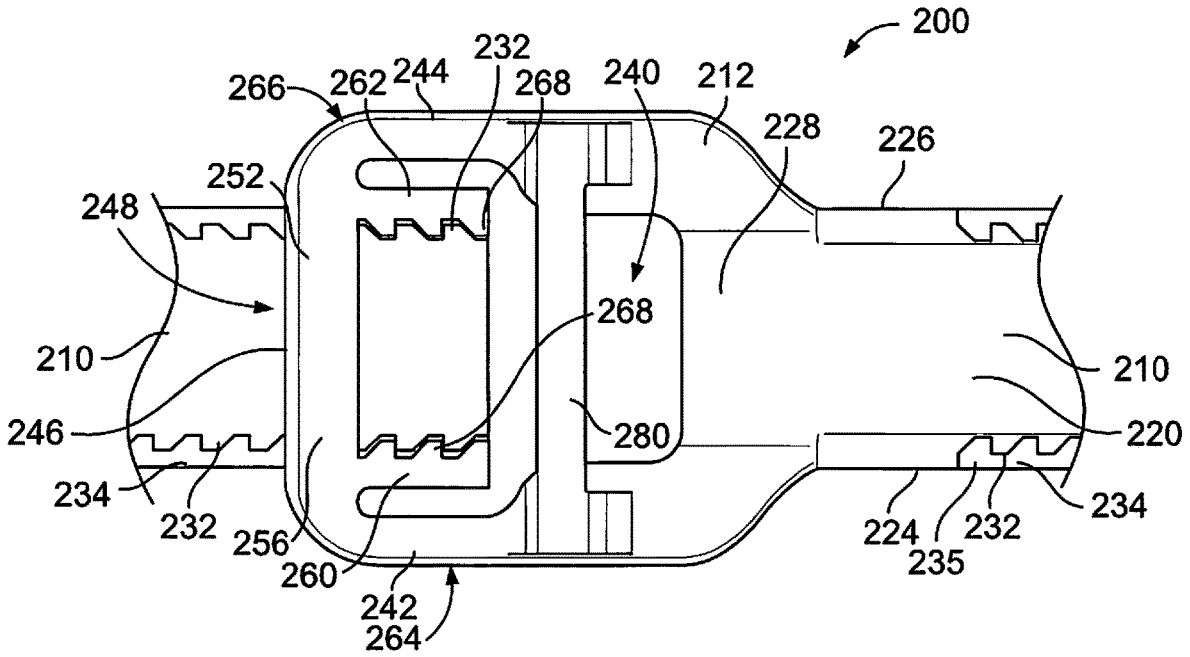
FIG. 9 is a top view of a portion of a low profile component tie in accordance with an exemplary embodiment and in an assembled state.
Figure 10:
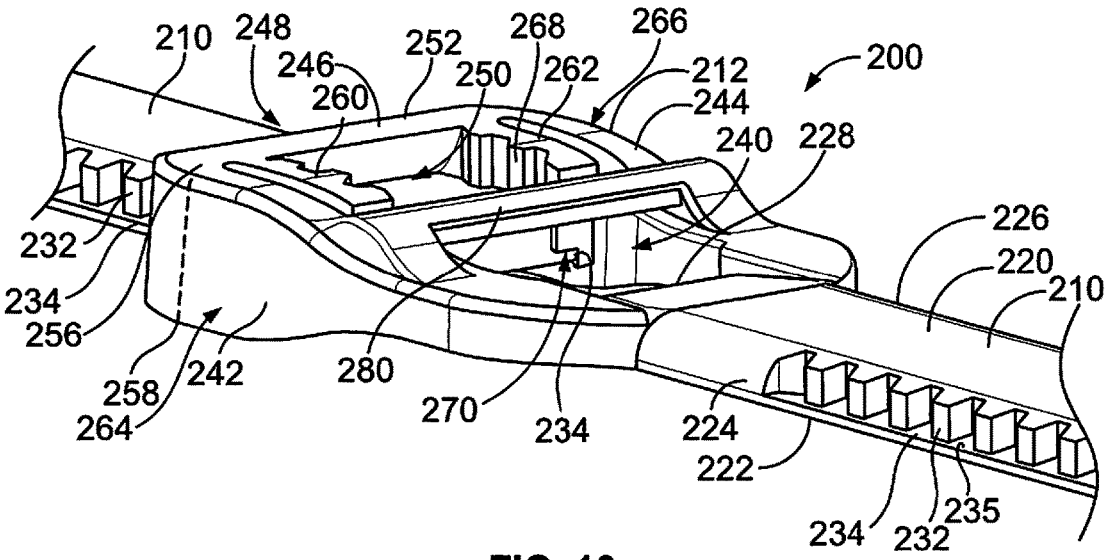
FIG. 10 is a perspective view of a portion of the component tie shown in FIG. 9 in the assembled state.
Figure 11:
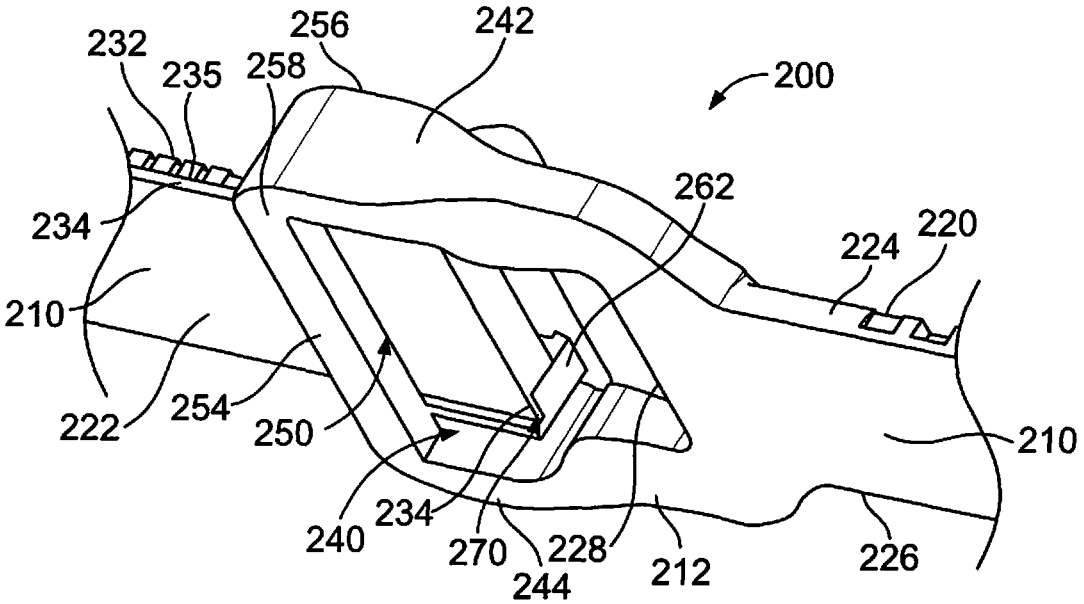
FIG. 11 is a bottom perspective view of a portion of the component tie shown in FIG. 9 in an assembled state.
Figure 12:
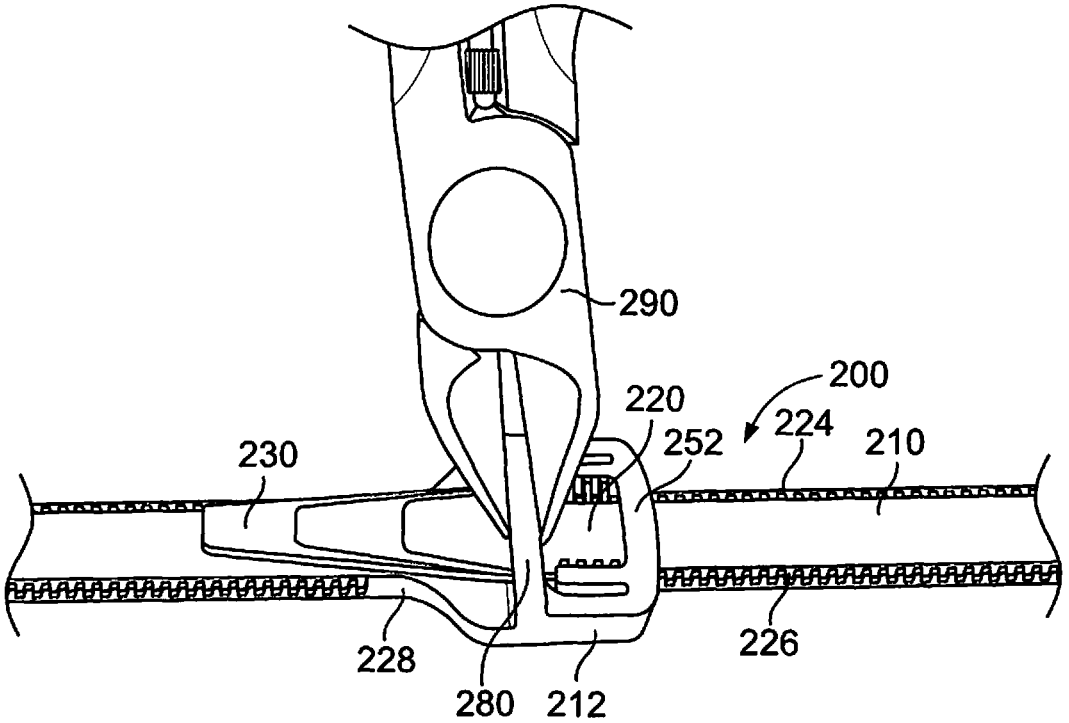
FIG. 12 is a top perspective view of a portion of the component tie shown in FIG. 9 in an assembled state with a removal tool configured to un-assemble the component tie.

FIG. 9 is a top view of a portion of a low profile component tie 200 in an assembled state. FIG. 10 is a perspective view of a portion of the component tie 200 in the assembled state. FIG. 11 is a bottom perspective view of a portion of the component tie 200 in an assembled state. FIG. 12 is a top perspective view of a portion of the component tie 200 in an assembled state with a removal tool configured to un-assemble the component tie 200. The component tie 200 is similar to the component tie 100 (FIG. 2) and includes similar features identified with similar names and reference numbers. The component tie 200 may be used in a similar manner as the component tie 100 to wrap around and/or secure one or more components 102 (shown in FIG. 1).

The component tie 200 includes a strap 210 and a head 212 provided at an end of the strap 210. The strap 210 may be self-secured to the head 212 after wrapping around one or more of the components 102 (shown in FIG. 1). The strap 210 has a top 220 and a bottom 222 opposite the top 220. The strap 210 includes sides 224, 226 extending between the top 220 and the bottom 222. The sides 224, 226 have a height measured by the thickness between the top 220 and the bottom 222. The strap 210 extends between a root end 228 and a distal end 230 (FIG. 12) opposite the root end 228. The strap 210 has a width defined between the sides 224, 226 and a length defined between the root end 228 and the distal end 230.

In an exemplary embodiment, the strap 210 includes a plurality of teeth 232 disposed along the first side 224 and/or the second side 226. The teeth 232 are contained within the thickness. In an exemplary embodiment, the strap 210 includes a band 234 below the teeth 232. In the illustrated embodiment, both sides 224, 226 include teeth 232 and both sides 224, 226 include bands 234. The bands 234 may be provided at or near the bottom 222. The bands 234 may be equal in width or wider than the teeth 232. The bands 234 define ledges 235 below the spaces between the teeth 232 and/or beyond the tips of the teeth 232. The bands 234 may be captured below the ratchet feature of the head 212, such as to ensure that the strap 210 remains engaged on the ratchet feature and does not slip off the ratchet feature. The bands 234 may protect other neighboring components, such as other cables, from the teeth 232. Optionally, the bottom 222 and the bottom of the bands 234 may be coplanar and define a surface configured to rest snuggly against the component 102 when the strap 110 is wrapped around the component 102.

The head 212 includes a channel 240 configured to receive the strap 210. The head 212 includes first and second arms 242, 244 on opposite sides of the channel 240. The head 212 includes an end wall 246 at a loading end 248 of the head 212 generally opposite the root end 228. The strap 210 is configured to be loaded into the channel 240 through the end wall 246 at the loading end 248. For example, the strap 210 may be loaded through an opening 250 in the end wall 246. The opening 250 may be defined by an upper support bar 252 and/or a lower support bar 254. The upper support bar 252 is provided at a top 256 of the head 212 while the lower support bar 254 is provided at a bottom 258 of the head 212. The opening 250 is shaped to receive the strap 210 (e.g., the opening 250 has a complementary shape as the outer profile of the strap 210, including the teeth 232 and the bands 234).

In an exemplary embodiment, the head 212 includes one or more pawls in the channel 240. In the illustrated embodiment, the head 212 includes a first pawl 260 and a second pawl 262. The first pawl 260 is provided at a first side 264 of the head 212, such as at or near the first arm 242, and the second pawl 262 is provided at a second side 266 of the head 212, such as at or near the second arm 244. The pawls 260, 262 include pawl teeth 268 configured to be received in the spaces between the teeth 232 of the strap 210 to engage the teeth 232 to hold the position of the strap 210 with respect to the head 212. For example, as the strap 210 is loaded through the opening 250 into the channel 240, the pawls 260, 262 ratchet down the sides of the strap 210. By providing the pawls 260, 262 along the sides, as opposed to along the top or the bottom, the head 212 has a lower profile. The pawls 260, 262 resist back out of the strap 210 from the head 212 to lock the strap 210 in the head 212.

In an exemplary embodiment, the pawls 260, 262 include grooves 270 along bottom sides of the pawls 260, 262. The grooves 270 receive corresponding bands 234. The ledges 235 are captured below the pawl teeth 268, which may secure the strap 110 in the channel 240, such as by resisting upward movement of the strap 110.

The head 212 includes a support bar 280 extending across the top 256 of the head. The support bar 280 may be positioned near the root end 228. When assembled, the distal end 230 (FIG. 12) is loaded through the opening 250 and passes below the support bar 280. The support bar 280 ensures that the strap 210 does not lift out of the channel 240 during assembly. Optionally, an installation tool (not shown) may be used to install the component tie 200. For example, the installation tool may pull the distal end 230 to tighten the strap 210. The installation tool may rest against the support bar 280 during installation. The support bar 280 provides a bearing surface for the installation tool to fix against the head 212 to pull against the strap 210. In embodiments that do not include the support bar 280, the installation tool may rest against another portion of the head 212, such as ramps or other surfaces provided on the head 212, such as at the transition from the strap 210 into the head 212. Optionally, the installation tool may include a shear or other cutting feature to cut off the excess portion or end of the strap 110, such as the portion of the strap downstream of the pawls 260, 262.

In an exemplary embodiment, removal of the component tie 200 from the component 102 may be accomplished using the removal tool 290. The removal tool 290 may be a cutter or other device used to cut portions of the component tie 200. In an exemplary embodiment, the removal tool 290 may remove any portions of the component tie 200 above the end of the strap 100, such as the support bar 280 and/or the upper support bar 252, to allow the head 212 to open up from above for removal of the strap 210 from the head 212. Such process eliminates damage to the component 102. For example, the removal tool 290 does not engage the component 102 whatsoever as the strap 210 is positioned between the component 102 and the removal tool 290. The tips of the removal tool 290 engage the top of the strap 210 and do not interact with the component 102, as opposed to conventional cable ties that are removed by inserting the cutter between the strap and the component to cut the strap from the side.

Figure 13:
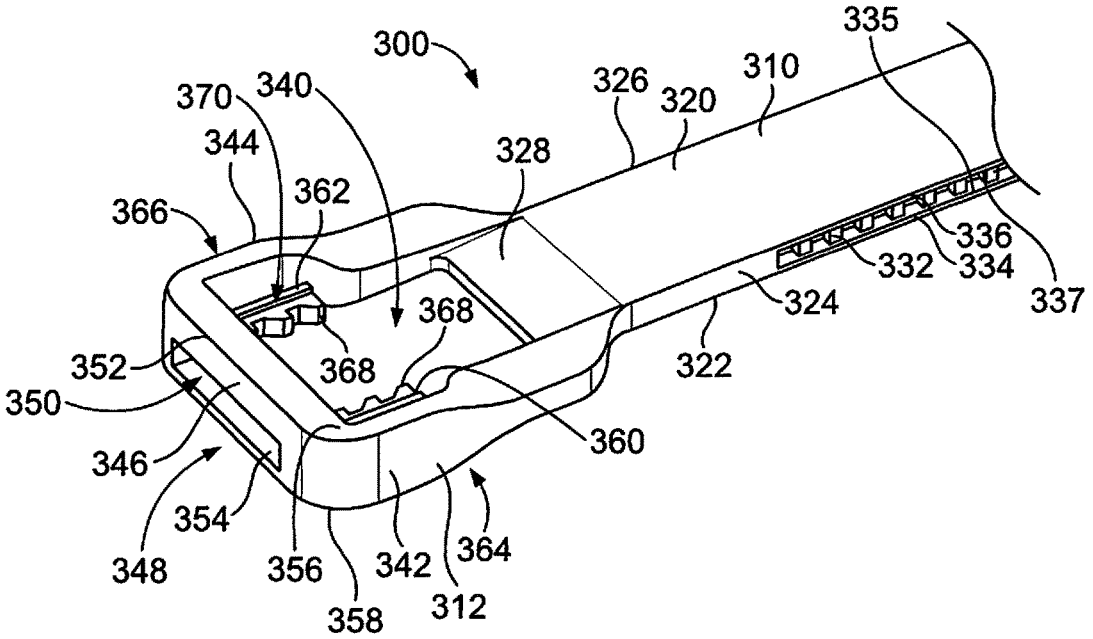
FIG. 13 is a front perspective view of a portion of a low profile component tie formed in accordance with an exemplary embodiment.
Figure 14:
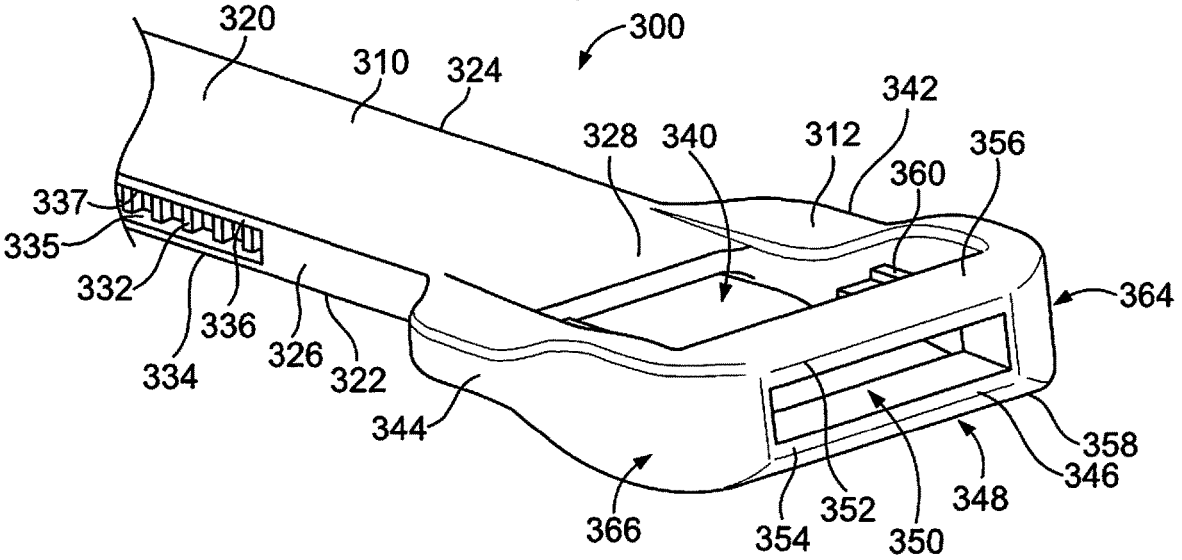
FIG. 14 is a rear perspective view of a portion of the component tie shown in FIG. 13.
Figure 15:
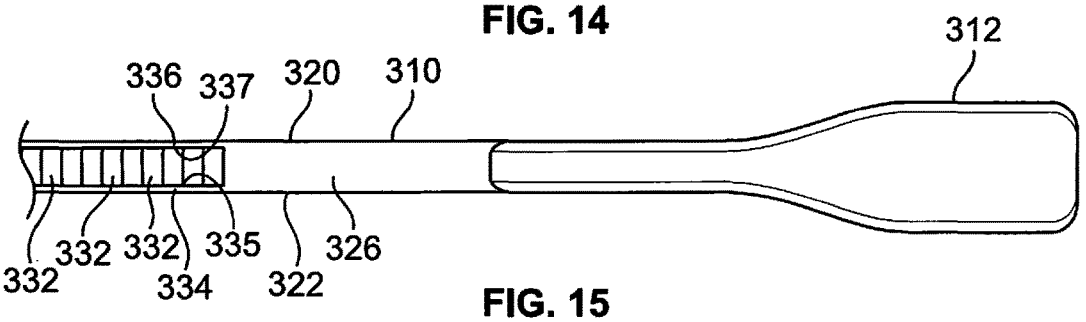
FIG. 15 is a side view of a portion of the component tie shown in FIG. 13.
Figure 16:
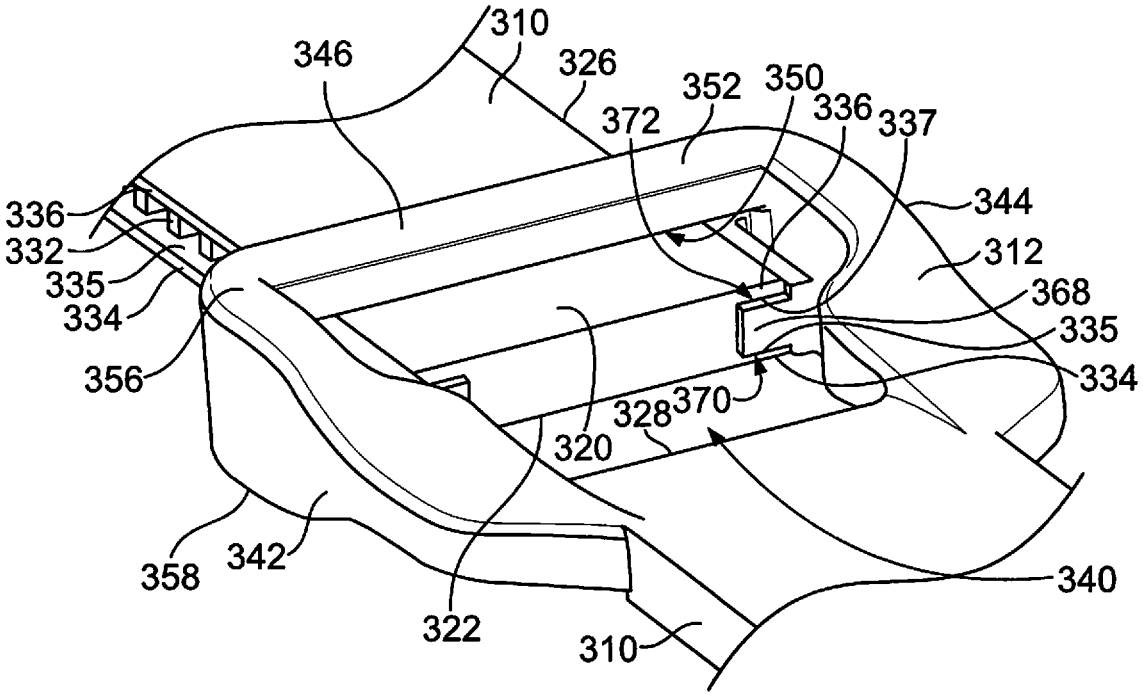
FIG. 16 is a top perspective view of a portion of the component tie shown in FIG. 13 in an assembled state.

FIG. 13 is a front perspective view of a portion of a low profile component tie 300. FIG. 14 is a rear perspective view of a portion of the component tie 300. FIG. 15 is a side view of a portion of the component tie 300. FIG. 16 is a top perspective view of a portion of the component tie 300 in an assembled state. The component tie 300 is similar to the component tie 100 (FIG. 2) and includes similar features identified with similar names and reference numbers. The component tie 300 may be used in a similar manner as the component tie 100 to wrap around and/or secure one or more components 102 (shown in FIG. 1).

The component tie 300 includes a strap 310 and a head 312 provided at an end of the strap 310. The strap 310 may be self-secured to the head 312 after wrapping around one or more of the components 102 (shown in FIG. 1). The strap 310 has a top 320 and a bottom 322 opposite the top 320. The strap 310 includes sides 324, 326 extending between the top 320 and the bottom 322. The sides 324, 326 have a height measured by the thickness between the top 320 and the bottom 322. The strap 310 extends between a root end 328 and a distal end (not shown) opposite the root end 328. The strap 310 has a width defined between the sides 324, 326 and a length defined between the root end 328 and the distal end.

In an exemplary embodiment, the strap 310 includes a plurality of teeth 332 disposed along the first side 324 and/or the second side 326. The teeth 332 are contained within the thickness. In an exemplary embodiment, the strap 310 includes a bottom band 334 below the teeth 332 and a top band 336 above the teeth 332. In the illustrated embodiment, both sides 324, 326 include teeth 332 and both sides 324, 326 include bands 334, 336. The bands 334 may be provided at or near the bottom 322. The bands 336 may be provided at or near the top 320. The bands 334, 336 may be wider than the teeth 332. The bands 334, 336 define ledges 335, 337, respectively, capping the teeth 332. In an exemplary embodiment, the ratchet feature of the head 312 may be captured between the bands 334, 336, such as to ensure that the strap 310 remains engaged on the ratchet feature and does not slip off the ratchet feature. In other various embodiments, upper and/or lower support bars may be provided to ensure that the strap 310 remains engaged on the ratchet feature. Optionally, the component tie 300 is symmetrical with the strap 310 being approximately centered with respect to the head 312.

The head 312 includes a channel 340 configured to receive the strap 310. The head 312 includes first and second arms 342, 344 on opposite sides of the channel 340. The head 312 includes an end wall 346 at a loading end 348 of the head 312 generally opposite the root end 328. The strap 310 is configured to be loaded into the channel 340 through the end wall 346 at the loading end 348. For example, the strap 310 may be loaded through an opening 350 in the end wall 346. The opening 350 may be defined by an upper support bar 352 and/or a lower support bar 354. The upper support bar 352 is provided at a top 356 of the head 312 while the lower support bar 354 is provided at a bottom 358 of the head 312. The opening 350 is shaped to receive the strap 310 (e.g., the opening 350 has a complementary shape as the outer profile of the strap 310, including the teeth 332 and the bands 334).

In an exemplary embodiment, the head 312 includes one or more pawls in the channel 340. In the illustrated embodiment, the head 312 includes a first pawl 360 and a second pawl 362. The first pawl 360 is provided at a first side 364 of the head 312, such as at or near the first arm 342, and the second pawl 362 is provided at a second side 366 of the head 312, such as at or near the second arm 344. The pawls 360, 362 include pawl teeth 368 configured to be received in the spaces between the teeth 332 of the strap 310 to engage the teeth 332 to hold the position of the strap 310 with respect to the head 312. For example, as the strap 310 is loaded through the opening 350 into the channel 340, the pawls 360, 362 ratchet down the sides of the strap 310. By providing the pawls 360, 362 along the sides, as opposed to along the top or the bottom, the head 312 has a lower profile. The pawls 360, 362 resist back out of the strap 310 from the head 312 to lock the strap 310 in the head 312.

In an exemplary embodiment, the pawls 360, 362 include lower grooves 370 and upper grooves 372 along bottom sides and top sides, respectively, of the pawls 360, 362. The grooves 370 receive corresponding lower bands 334. The grooves 372 receive corresponding upper bands 336. The pawl teeth 368 are positioned between the bands 334, 336. For example, the ledges 335 are captured below the pawl teeth 368 and the ledges 337 are captured above the pawl teeth 368, which may secure the strap 110 in the channel 340, such as by resisting upward movement of the strap 110.

Figure 17:
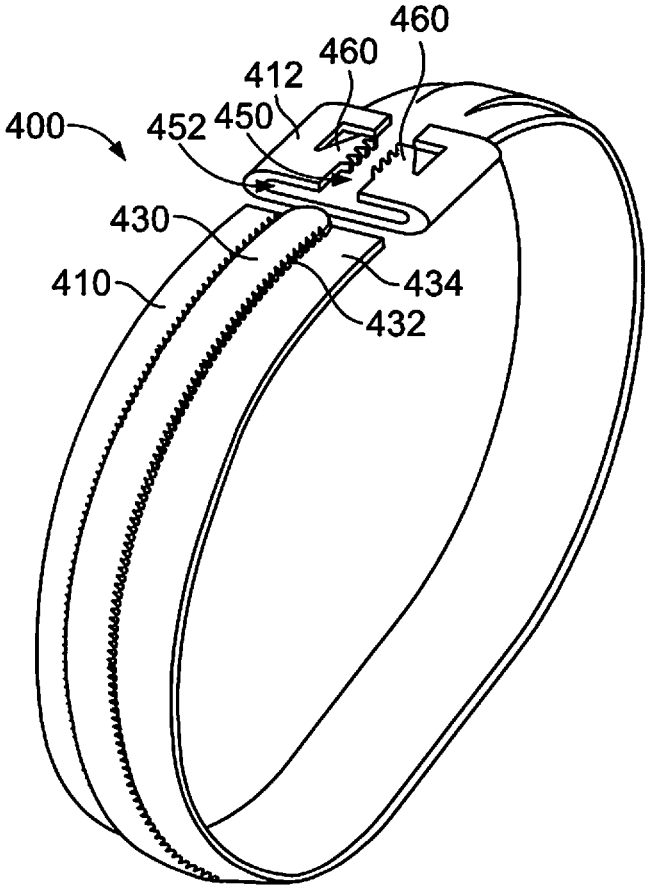
FIG. 17 is a perspective view of a low profile component tie formed in accordance with an exemplary embodiment.

FIG. 17 is a perspective view of a low profile component tie 400. The component tie 400 is similar to the component tie 200 (FIG. 9) and includes similar features identified with similar names and reference numbers. The component tie 400 may be used in a similar manner as the component tie 100 to wrap around and/or secure one or more components 102 (shown in FIG. 1).

The component tie 400 includes a strap 410 and a head 412 provided at an end of the strap 410. The strap 410 includes a rail 430 having a plurality of teeth 432 and a band 434 below the rail 430. The rail 430 is narrower than the strap 210 (FIG. 9) and the band 434 extends further beyond the sides of the rail 430 than the band 234 (FIG. 9). The rail 430 is configured to be received in the head 412 through an opening 450. The opening 450 includes a groove 452 that receives the band 434. The head 412 includes pawls 460 that engage the teeth 432.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A low profile component tie comprising:

a strap having a top and a bottom, the strap configured to wrap around a component with the bottom facing the component, the strap having sides between the top and the bottom, the strap having teeth disposed along at least one of the sides, the strap extending between a root end and a distal end; and a head having a front and a rear, the front provided at the root end of the strap with the strap extending forward from the head, the head having a channel extending between the rear and the front configured to receive the strap such that the strap extends from the rear to the front of the head as the strap passes through the head, the head having at least one pawl provided in the channel, the pawl engaging at least one of the teeth along the side of the strap to secure the strap in the head, wherein the root end of the strap is ramped to at least one of the top and the bottom to guide the strap to the corresponding top or the bottom of the strap at the root end such that the strap is parallel and stacked on the root end.

2. The low profile component tie of claim 1, wherein the strap includes teeth on both sides, the head having at least two pawls to engage the teeth on both sides.

3. The low profile component tie of claim 1, wherein the strap has a thickness between the top and the bottom, the teeth being contained within the thickness of the strap.

4. The low profile component tie of claim 1, wherein the top and the bottom are smooth.

5. The low profile component tie of claim 1, wherein the strap includes a bottom band below the teeth at or near the bottom.

6. The low profile component tie of claim 5, wherein the strap includes a top band above the teeth at or near the top.

7. The low profile component tie of claim 1, wherein the strap and the head are symmetrical about a central plane between the top and the bottom.

8. The low profile component tie of claim 1, wherein the at least one pawl of the head includes first and second pawls arranged on opposite sides of the channel receiving the strap therebetween.

9. The low profile component tie of claim 8, wherein the head includes an opening to the channel at a loading end of the head opposite the root end of the strap, the opening receiving the strap.

10. The low profile component tie of claim 1, wherein the at least one pawl includes pawl teeth received in spaces between the teeth of the strap to engage the teeth of the strap to hold a position of the strap with respect to the head.

11. The low profile component tie of claim 10, wherein the pawl teeth have different widths.

12. The low profile component tie of claim 1, wherein the strap is held in alignment with the pawl for operative engagement therewith by the channel.

13. The low profile component tie of claim 1, wherein the strap has a thickness between the top and the bottom of the strap, the head has a thickness between a top and a bottom of the head, the head containing the thickness of the strap within the thickness of the head.

14. The low profile component tie of claim 1, wherein the head includes a support bar spanning the channel.

15. A low profile component tie comprising:

a strap having a top and a bottom, the strap extending between a root end and a distal end, the strap configured to wrap around a component with the bottom facing the component, the strap having sides between the top and the bottom, the strap having teeth disposed along at least one of the sides; and a head extending between a loading end and a ramp opposite the loading end, the ramp being provided at the root end of the strap to guide the strap to the top of the strap at the root end such that the strap is parallel and stacked on the root end, the head having a channel at the loading end configured to receive the strap and guide the strap to the ramp, the head having at least one pawl provided in the channel, the at least one pawl engaging at least one of the teeth along the side of the strap to secure the strap in the head.

16. The low profile component tie of claim 15, wherein the strap includes a bottom band below the teeth at or near the bottom and a top band above the teeth at or near the top, at least one of the bottom band and the top band engaging the at least one pawl.

17. A low profile component tie comprising:

a strap having a top and a bottom, the strap configured to wrap around a component with the bottom facing the component, the strap having sides between the top and the bottom, the strap having teeth disposed along at least one of the sides, the strap extending between a root end and a distal end; and a head having a front and a rear, the front provided at the root end of the strap with the strap extending forward from the head, the head having a channel extending between the rear and the front configured to receive the strap such that the strap extends from the rear to the front of the head as the strap passes through the head, the head having at least one pawl provided in the channel, the pawl engaging at least one of the teeth along the side of the strap to secure the strap in the head, wherein the channel is bounded at opposite sides by first and second arms and is bounded at a loading end opposite the root end of the strap by an end wall, the end wall having an opening therethrough, the strap passing through the opening to the channel parallel to the first and second arms, the end wall having a support bar defining a top of the opening, the strap being removable from the head by cutting the support bar and allowing the strap to be disengaged from the pawl and removed through the support bar, and wherein the strap includes a bottom band below the teeth at or near the bottom.

* * * * *